United States Patent [19]

Zins

[11] 4,272,113

[45] Jun. 9, 1981

[54] SLIDING DOOR SAFETY BAR

[76] Inventor: Raymond V. Zins, 228 Crestridge Ave., Colorado Springs, Colo. 80906

[21] Appl. No.: 66,040

[22] Filed: Aug. 13, 1979

[51] Int. Cl.[3] ..... E05C 17/12

[52] U.S. Cl. ..... 292/262; 292/DIG. 49

[58] Field of Search ..... 292/DIG. 49, 305, 262, 292/259, 202, 339

[56] References Cited

U.S. PATENT DOCUMENTS

| | | | |
|---|---|---|---|
| 3,328,920 | 7/1967 | Cohen et al. | 292/DIG. 46 |
| 3,698,754 | 10/1972 | Means | 292/262 |

*Primary Examiner*—Richard E. Moore

*Attorney, Agent, or Firm*—Richard W. Hanes

[57] ABSTRACT

The invention relates to a supplemental locking device for panel type doors which are mounted in a frame having top and bottom members and where one panel is adapted to open by sliding with respect to the other into a position adjacent the other door panel. More particularly, the apparatus of the invention includes a vertically disposed mounting post attached to the top and bottom door frame members and having a rigid bar pivotally attached to the mounting post so as to abut against or lock onto the handle or other part of the frame of the movable door so as to prevent the movable door from being open when the locking bar is perpendicular to the mounting post and in contact with the sliding door's handle.

2 Claims, 4 Drawing Figures

SLIDING DOOR SAFETY BAR

BACKGROUND OF THE INVENTION

Locking devices for relatively sliding parallel door panels have included conventional key operated locks as well as the use of a simple rigid bar placed between the sliding panel and the door jamb for supplemental security. The use of the bar to block the sliding movement of the sliding door panel, however, is limited, at least in its simple form, to instances where the sliding door is interiorly placed with respect to the fixed one of the two door panels. When the sliding door panel slides past the fixed door panel on the outside of the fixed panel, there is no way to place a simple blocking device which would be secure against easy removal.

Several attempts have been made to provide locking bars for different types of "patio doors" such as the ones shown in U.S. Pat. Nos. 3,608,940, 3,478,471, 3,328,920 and 3,821,884. Each of the devices disclosed in these patents is complex and requires extensive modification of the door and, in some cases such as in U.S. Pat. No. 3,608,940, the device requires the presence of a door frame with rather large dimensions and of suitable material to allow the attachment of the safety lock to the fixed door framing member. In instances where the glass door panel frame is constructed of an aluminum extrusion, for example, it would not be possible to attach a locking bar such as the ones disclosed in the aforementioned patents.

OBJECTS OF THE INVENTION

It is therefore the principal object of the present invention to provide a simple, effective and inexpensive locking bar for a sliding door which can be used with an exteriorly disposed sliding door without requiring any attachment to the frame of the fixed door panel.

Another object of the invention is to provide a security locking bar for sliding doors whose points of attachment are plural and are located at the top and bottom of the door frame where rigidity of the frame is at a maximum, for additional security against prying between the fixed and sliding door.

Other and further objects, features and advantages of the present invention will become apparent from a reading of the following detailed description of a preferred form of the invention taken in connection with the accompanying drawings in which.

DESCRIPTION OF THE INVENTION

Figure 1:
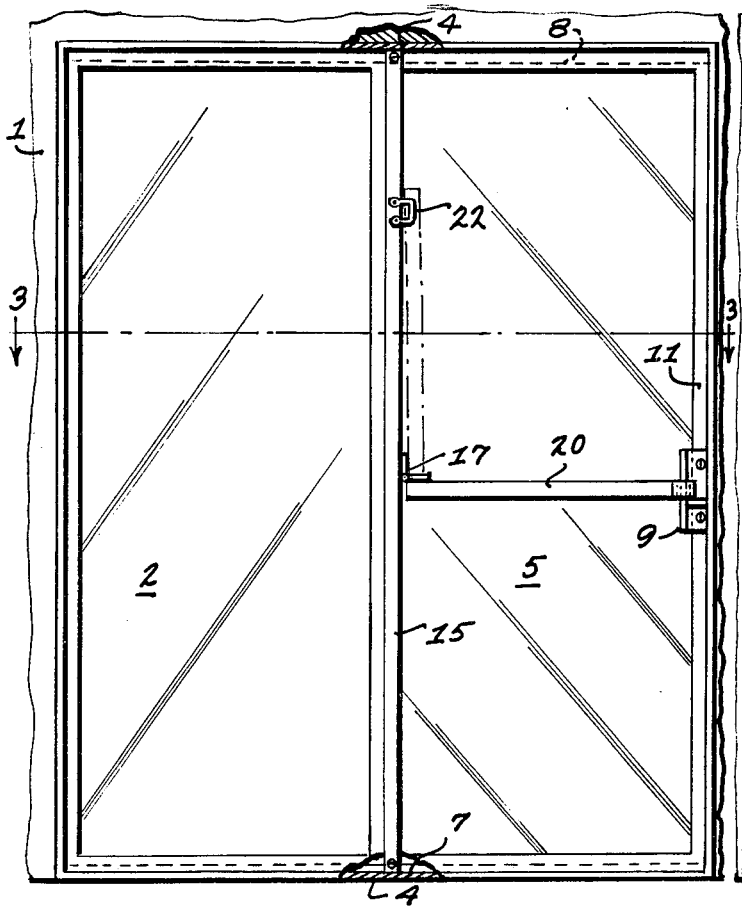
FIG. 1 is a fragmentary interior side view of a building wall showing the doorway portion thereof and having mounted therein a pair of relatively sliding parallel door panels, with portions thereof broken away and shown in cross section.
Figure 2:
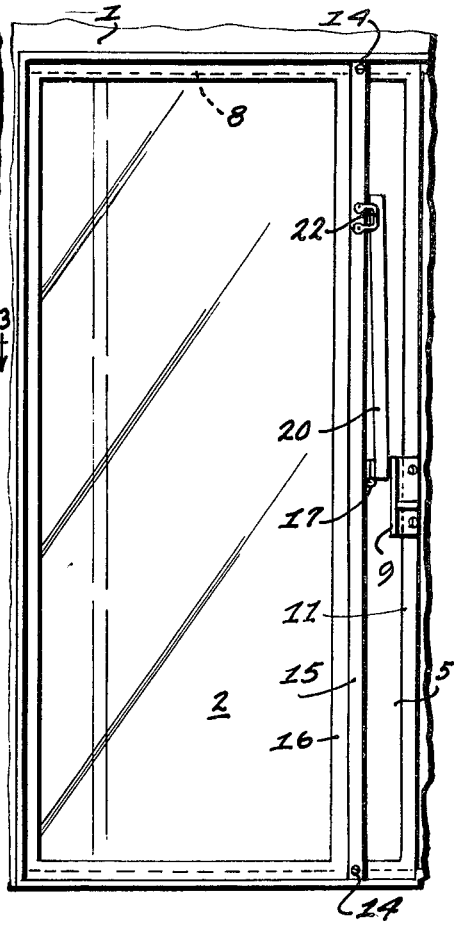
FIG. 2 is a fragmentary interior side view of a building wall showing the doorway portion thereof and having mounted therein a pair of relatively sliding parallel door panels with the sliding one of the two panels shown in the "open" position and where the one sliding panel is positioned adjacent to and outside of the fixed panel.
Figure 3:
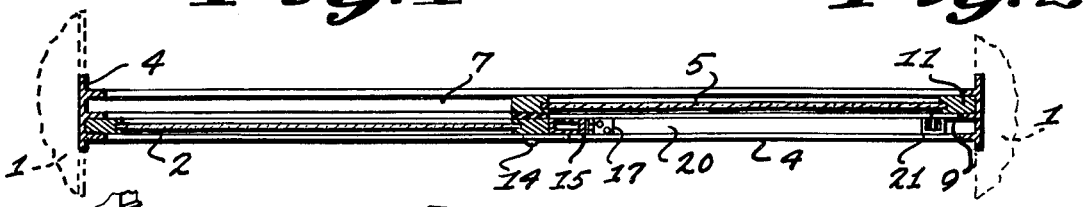
FIG. 3 is a cross sectional view taken along line 3—3 of FIG. 1.

Conventional, relatively slideable, panel doors are shown in FIGS. 1, 2 and 3 in an installation in a building wall 1 where a fixed position framed glass panel door 2 is mounted in a door frame 4 and a second sliding glass door panel 5 is mounted in the same frame 4 and is movable in the channels 7 and 8 at the top and bottom respectively of the door frame 4. The sliding door 5 slides to a position adjacent to and exteriorly of the fixed door panel 2, as shown in FIG. 2. Customarily, the sliding door panel is equipped with a handle 9 protruding inwardly from and secured to or made a part of the sliding door frame 11.

Figure 4:
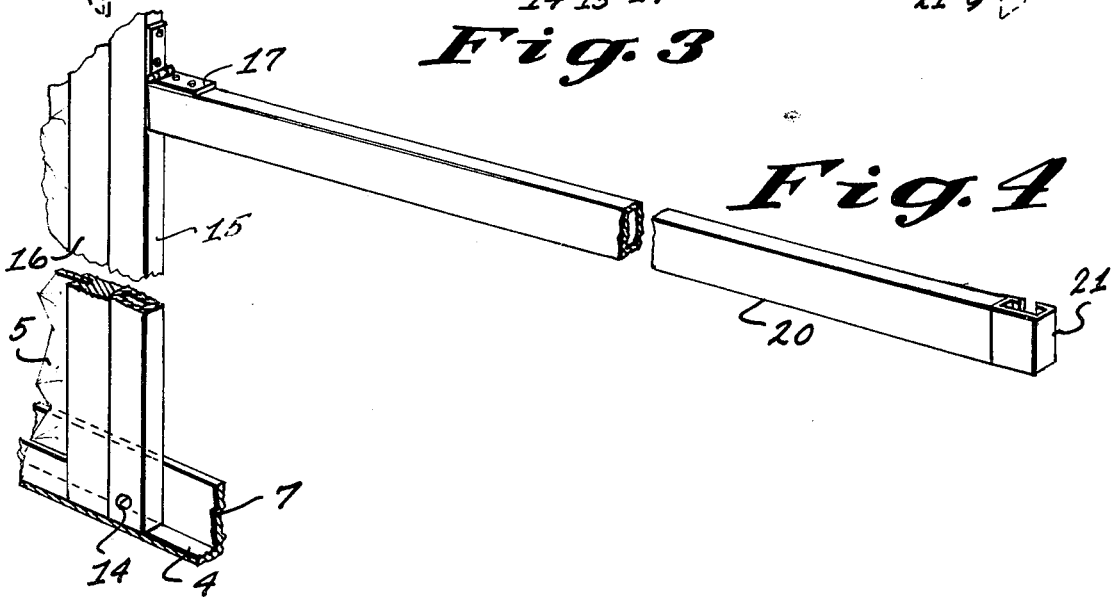
FIG. 4 is a fragmentary perspective view of the security locking bar and the vertically disposed mounting post to which the bar is pivotally attached.

According to the present invention, the security device comprises a sturdy mounting post 15 sized and dimensioned to be mounted vertically next to the glass frame 16 of the fixed door panel 2. The post 15 is fastened by screws 14 or other appropriate means to the bottom and top channel portions 7 and 8 of the door frame 4. At approximately the mid-point of the mounting post 15, an appropriate length of extruded aluminum rod 20 or other convenient rigid material is attached to the post 15 by a hinge 17. The hinge is disposed so as to allow the security locking rod 20 to selectively be positioned perpendicular to the mounting post, as shown in FIGS. 1, 3 and 4, or to be raised to a position parallel to the mounting post, as shown in FIG. 2.

The hinge 17 is positioned on the post 15 at a point which will place the rod 20 in a position to abut or connect with the sliding door handle 9 when the rod is pivoted to a positioned perpendicular to the mounting post 15.

For additional tightness and rigidity of the system, the unhinged end of the rod 20 may be provided with a handle engaging extrusion 21 or similar device to interconnect the door handle and the locking rod.

A springable metal catch 22 may be installed on the upper portion of the mounting post 15 to secure the locking bar in its raised position, as shown in FIG. 2.

It is seen that all of the advantages of prior bar-type locking devices may be achieved with the apparatus of the present invention without modification to the existing doors and can be universally applied, regardless of the type of door frame with which the device may be used.

I claim:

1. A supplemental locking device for relatively sliding parallel door panels mounted in a door frame having parallel top and bottom members, comprising:

a fixed door panel;

a slidable door panel having a frame movable in a plane parallel to the plane of the fixed panel and into juxtaposition therewith;

a rigid mounting post vertically disposed between the said top and bottom frame members and perpendicular thereto and intermediate the lateral extremities of the said door panels;

means attaching the mounting post to the top and bottom frame members;

hinge means attached to the mounting post intermediate the top and bottom ends thereof; and a rigid locking bar attached at its one end to the hinge means and adapted to pivot with respect to the mounting post in a plane parallel to the said door panels and adapted to abut its free end against the frame member of the slidable panel to prevent sliding movement thereof.

2. The combination of claim 1 and further including clasp means attached to the unhinged end of the locking bar.

* * * * *